US005110316A

United States Patent [19]

Shaw et al.

[11] Patent Number: 5,110,316

[45] Date of Patent: May 5, 1992

[54] PRACTICAL JOKE DEVICE

[75] Inventors: David Shaw, 28 Moorfield Drive, Halesowen, West Midlands B63 3TG; Christopher L. Birch, London, both of England

[73] Assignee: David Shaw, United Kingdom

[21] Appl. No.: 482,016

[22] PCT Filed: Jun. 16, 1989

[86] PCT No.: PCT/GB89/00674

§ 371 Date: Feb. 20, 1990

§ 102(e) Date: Feb. 20, 1990

[87] PCT Pub. No.: WO89/12489

PCT Pub. Date: Dec. 28, 1989

[30] Foreign Application Priority Data

Jun. 18, 1988 [GB] United Kingdom ..... 8814555

[51] Int. Cl.[5] ..... A63H 33/40; A63H 37/00

[52] U.S. Cl. ..... 446/202; 40/439

[58] Field of Search ..... 446/202-209, 446/176, 199, 200; 40/439, 477, 478, 422, 412, 212, 214; 272/27 N, 27 R

[56] References Cited

U.S. PATENT DOCUMENTS

| | | | |
|---|---|---|---|
| 530,909 | 12/1894 | Stone | 446/204 |
| 2,282,056 | 5/1942 | Hoeflich | 446/209 |
| 2,486,158 | 10/1949 | Haas | 40/214 X |
| 3,729,847 | 5/1973 | Chandos | 40/212 X |
| 4,447,250 | 5/1984 | Wolens et al. | 446/202 X |
| 4,579,826 | 8/1986 | Bolton et al. | 446/202 X |

*Primary Examiner*—Mickey Yu
*Attorney, Agent, or Firm*—Neil F. Markva

[57] ABSTRACT

A practical joke device comprises a mouthpiece attached to a rolled-up (or deflated) display portion. The display portion can be unrolled (or inflated) and thereby extended by delivering air thereto by way of the mouthpiece, in order, in use, to display information carried thereon. The display portion comprises a panel adapted for carrying and displaying information. The panel has such size and dimensions that, in the unrolled, extended (or inflated) state at least one dimension of the panel is about 3 or more times greater than the width of the mouthpiece. The at least one dimension is generally transverse to the extension direction of the display panel. In the unrolled, extended (or inflated) state, the extension direction of the display panel may be displaced from the axis of the mouthpiece.

1 Claim, 2 Drawing Sheets

PRACTICAL JOKE DEVICE

FIELD OF THE INVENTION

This invention relates to a practical joke device and more particularly to a device having a mouthpiece with a rolled-up portion, which portion can be unrolled and thereby extended, with air delivered thereto by way of the mouthpiece.

BACKGROUND OF THE INVENTION

In such devices, the rolled-up portion generally comprises a long narrow paper tube, closed at one end, which is of flat section in the rolled-up state and held in the rolled-up state by means of a wire spring which extends the length of the tube. As air is delivered to the tube by way of the mouthpiece the tube is inflated and thereby unrolled to a fully extended position against the inherent spring resilience of the wire spring. Often the mouthpiece includes a pivotable diaphragm so that the unrolling action of the tube is accompanied by a kazoo-like sound made by the air issuing past the diaphragm. On cessation of the delivery of air to the tube, the tube collapses and is returned to its original rolled-up state by way of said wire spring. The intentioned effect of the device is to induce surprise or joviality, usually in an unsuspecting observer. However, such devices have been in existence for many years and although they still may retain an element of fun such devices are well known so that their effects are not entirely unexpected, thereby,disadvantageously, tending to reduce the element of surprise or joviality and thereby, disadvantageously, tending to reduce the enjoyment level of the device.

It is an object of the present invention to alleviate one or more of the aforementioned disadvantages and/or to provide a practical joke device having a somewhat different or additional effect to the surprise effect already mentioned.

SUMMARY OF THE INVENTION

According to the present invention there is provided a practical joke device comprising a mouthpiece, attached to a rolled-up (or deflated) display portion, which display portion can be unrolled (or inflated) and thereby extended by delivering air thereto by way of the mouthpiece, in order, in use, to display information carried on. The display portion, said portion comprises a panel adapted for carrying and displaying information and:

a) having such size and dimensions that, in the unrolled, extended (or inflated) state at least one dimension of said panel at least about 3 times greater than the width of the mouthpiece, said at least one dimension being arranged generally transverse to the extension direction of said display panel, and/or b) being such that, in the unrolled, extended (or inflated) state the extension direction of the display panel is displaced from the axis of the mouthpiece.

Usually, said at least one dimension will be wide in relation to the width of the mouthpiece in order to be of sufficient width to accommodate a useful information content to an observer. The information content may comprise a message, slogan and/or pictures, for example of a humorous face, and/or advertising or promotional material. Preferably, the display panel will be generally circular or shaped like a "flat speech bubble" but could be square, rectangular or virtually any relatively large shape. Preferably, said at least one dimension is approximately the same as its extended dimension. The extended dimension could be much shorter than said at least one dimension. Said at least one dimension could be, 3, 4, 5, 6, 7, 8, 9, 10, 20, or 30 or more times greater than the width of the mouthpiece.

The display panel will usually be arranged at an angle to the axis of the mouthpiece, in the extended position, in order to provide information at a suitable orientation for the observer, while, advantageously, facing the observer to be able to view his emotional reaction to the information displayed. Preferably, said display panel will be arranged at right angles to the mouthpiece, so that, in use, information on the display panel will be presented in a generally vertical plane facing an observer.

Preferably, the mouthpiece is connected to (preferably integral with) an angled tube portion, and the display portion is attached to said angled tube portion, in order to be able to present information on the panel in a generally vertical (or possibly otherwise inclined) plane to an observer.

In one embodiment of the device, in use, information is displayed on a rear face (face remote from the mouthpiece) of the display panel, with said rear face facing an observer, the display panel being so shaped that the user, when facing the observer is able to simultaneously see the observer's reaction to the information being displayed. The display panel may be extended in a chosen upward or downward or sideways direction relative to the user, or could be adapted for use in some or each of these orientations to display different messages in different orientations on the display portion.

Preferably, in order to unroll the display portion to an extended position, at least a part thereof is inflatable by air delivered into the mouthpiece, and usually the display panel will include a central tube which is inflatable and which has a wire spring along the length thereof, in order to return the display panel to its original rolled-up state on cessation of the delivering of air to the mouthpiece.

In the extended state of the display portion, the display portion itself may be of any chosen two dimensional or three dimensional shape and in particular may be curved. It is possible that parts of the display device may be arranged to inflate in different directions to display information on several display panels in several planes of attitudes, perhaps simultaneously to different observers.

Usually, the mouthpiece will be of rigid plastics and, preferably, the display panel is of paper or other non-elastic material. The display panel could be of plastics and/or may be partially transparent. Where the display panel has at least a part which is inflatable it is possible that elastic materials may be used but said inflatable part should be quickly inflatable.

It is believed to be an important aspect of the present invention that the user can be facing an observer while using the device to display information in a favorable orientation to him. Nevertheless, the device could be used to an additional and/or opposite end. For example the device could be used to display a piece of information to an observer directly behind the user about a person facing the observer, the user may then initially be able to view the reaction of the person facing him rather than the observer behind him. The person facing him may simultaneously be provided with information of a different nature to that presented to the rearward observer yet believe he is being provided with the same information. Clearly, such a facility presents a greater facility for a variety of different practical jokes.

The present invention extends to the provision of a set of such practical joke devices provided with display devices including a different information content and/or different shapes or features which may be designed to display information in a variety of orientations. Such practical joke devices may be provided with interchangeable or additional display devices, mouthpieces, and/or with interchangeable or additional information for attachment/detachment to or from the display device.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Referring to FIGS. 1 to 4, a hand-held practical joke or display device 1 has a rigid plastics mouthpiece 2 with a longitudinal axis X—X. The mouthpiece 2 is formed integrally with an angled tube portion 3 which extends generally at right angles to the longitudinal axis X—X of the mouthpiece.

A display portion comprising in this instance a paper panel 4 (shown in a rolled-up state in FIGS. 1 and 2) that is non-integral with the mouthpiece and attached to the free end of the angled tube portion 3. The display panel 4 can be unrolled to the fully extended position shown in FIGS. 3 and 4 by delivering air thereto from the mouth by way of the mouthpiece 2 (i.e. by blowing into the mouthpiece).

Figure 3:
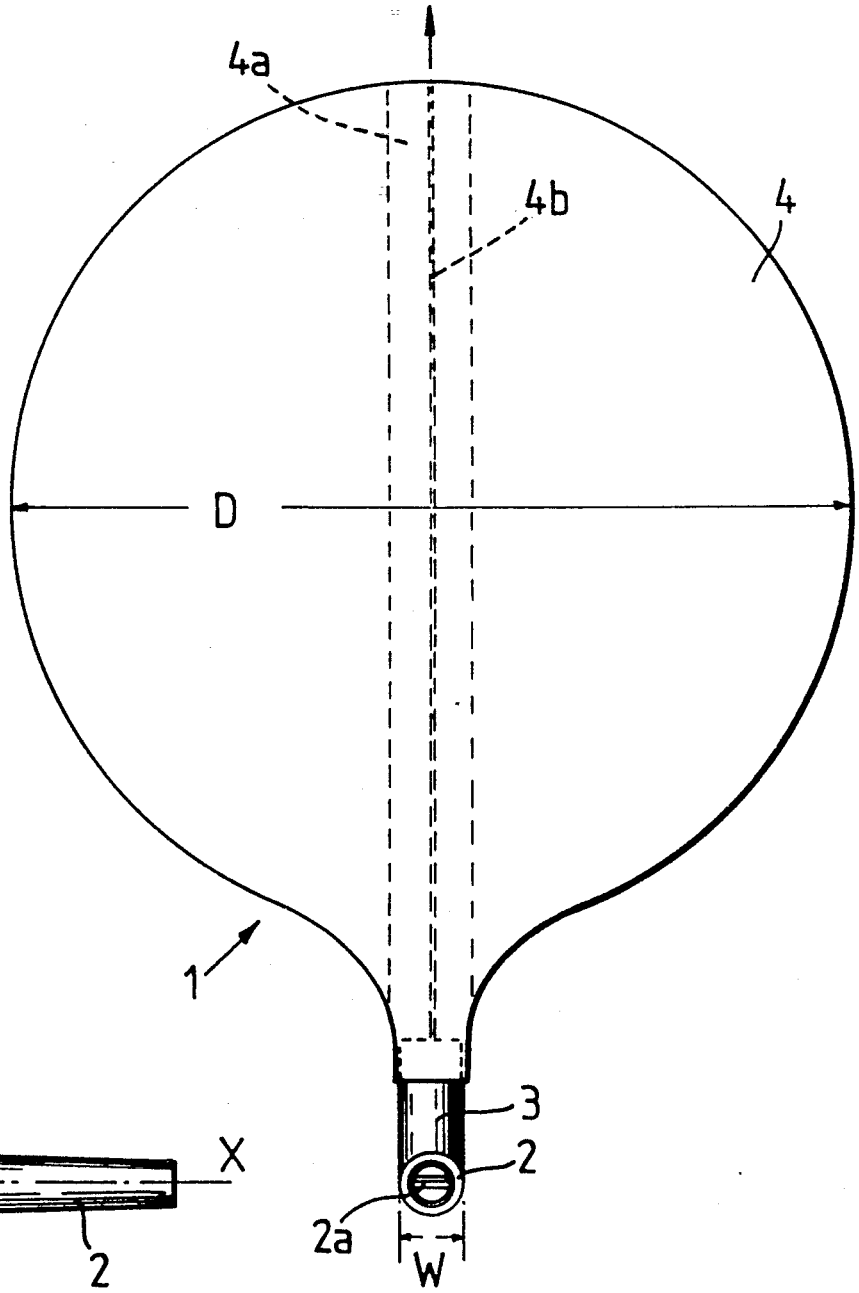
FIG. 3 is front elevational view similar to FIG. 2 showing the display panel in an unrolled, extended state.

As shown in FIG. 3 the display panel 4 has a dimension D, arranged generally transverse to the extension direction E of the display panel, which is wide in relation to the width W of the mouthpiece. As shown in FIG. 3, when the display panel is fully extended, it is generally circular and, therefore, dimension D is approximately the same length as the dimension F along the extension direction E.

The display panel 4 is adapted for carrying and displaying information and, in the embodiment shown in the FIGURES, the information will be displayed on the rear face $S_1$ (with respect to the orientation shown in FIG. 3) on the device. In use, the rear face $S_1$ will be facing an observer. The information content may comprise any matter considered suitable and could range, for example from pictorial representations such as a humorous face to words or slogans chosen to induce surprise and/or other emotions in an observer.

As shown, the extension direction E of the display panel 4 is displaced from, and in this instance angled relative to, the longitudinal axis X—X of the mouthpiece and is arranged generally at right angles thereto. Thus, in use, when air is blown into the mouthpiece the display panel is unrolled upwardly to present information appearing on face $S_1$ with face $S_1$ occupying a generally vertical plane facing the observer.

The diplay panel 4, in this instance, has a central elongate, paper tube **4*a* which is of flat section in the rolled-up state. A wire spring 4*b* extends centrally of the paper tube 4*a*. The paper tube 4*a* is quickly inflated when air is blown into the mouthpiece 2 and is thus unrolled to the fully extended state against the spring force or biassing provided by the inherent resilience of the wire spring 4*b*. As the central tube 4*a* is unrolled the remainder of the display panel 4 is also unrolled since it is attached to the central tube. Additionally the mouthpiece 2, in this instance, has a pivotable diaphragm 2*a* which enables a kazoo-like sound to be emitted as the display device is unrolled to a generally extended position. On cessation of the delivery of air to the mouthpiece, the display panel 4 is returned to its original rolled-up state by the inherent resilience of the wire spring 4*b***.

The arrangement of a rolled-up, inflatable paper tube closed at one end, including the wire spring connected to a mouthpiece with diaphragm for emitting a kazoo-like sound is generally known per se and, therefore, will not be described further in relation to the present invention. Moreover, the central paper tube may be designed to be inflated to a thickness greater than the inflated thickness T as shown (see FIG. 4) if desired. Any part or parts of the display panel 4 may be designed to be inflatable, and for example, the whole of the display panel could be a flat inflatable "balloon" or envelope. However, it is important that the display panel can be moved rapidly to its fully extended position in order to induce the required element of surprise or attention in an observer. Therefore, the thickness dimension of any inflatable portion of the display panel or portion should be relatively small and the inflatable volume of any inflatable parts of the display portion should be relatively small.

Preferably, in order to display information on the display panel 4 dimension D will be at least about 3 times greater than dimension F. Also, preferably, the extension direction E will, as shown, be displaced from the axis of the mouthpiece, but could be arranged at any desired angle thereto, rather than at a right angle. The display panel could be curved in the extended state.

Figure 1:
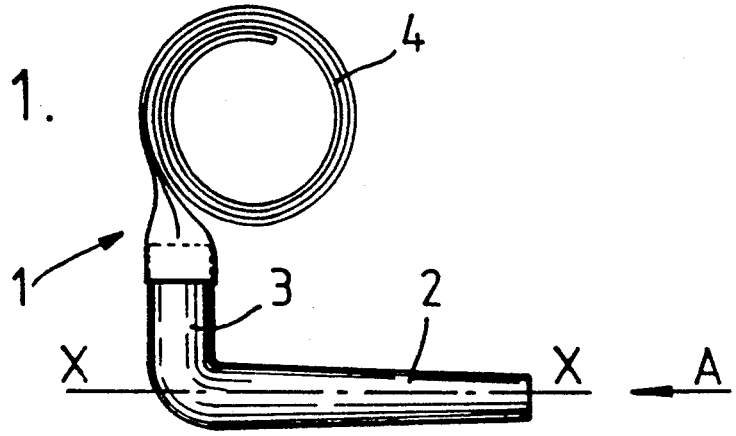
FIG. 1 is a elevational view of the device having a display portion comprising a panel in a rolled-up state.
Figure 2:
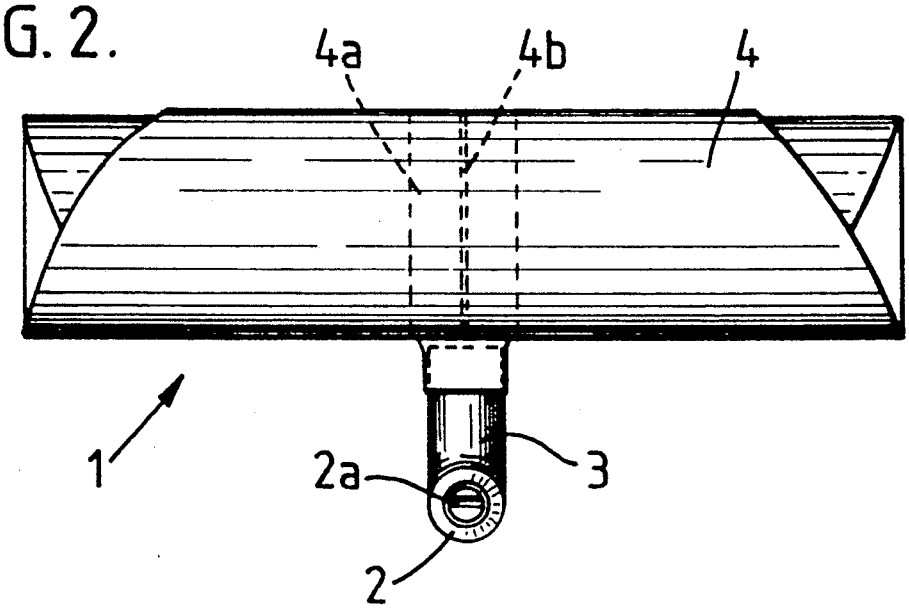
FIG. 2 is a front elevational view of the device looking in direction of A of FIG. 1 (i.e. looking directly into a mouthpiece of the device)
Figure 5:
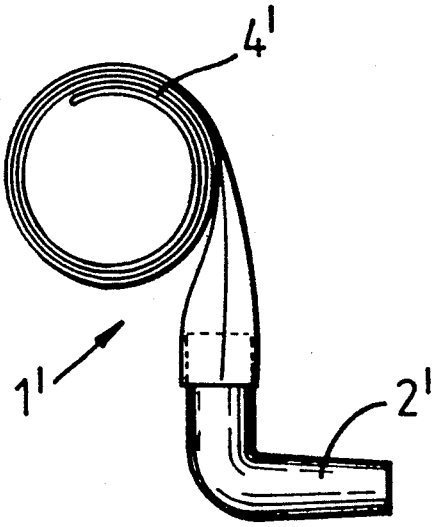
FIG. 5 is a side elevational view similar to FIG. 1 incorporating modifications to the display panel and mouthpiece.
Figure 4:
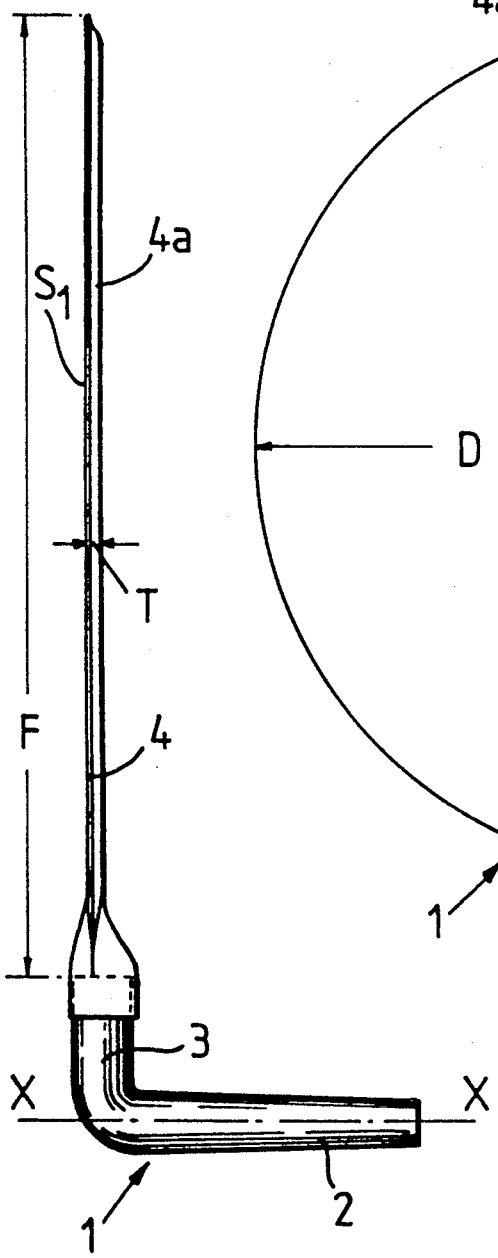
FIG. 4 is a side elevational view similar to FIG. 1 showing the display panel in the unrolled, extended state.

FIG. 5 incorporates a possible modification to the display panel and to the mouthpiece. FIG. 5 shows a display panel 4' which is rolled-up in the opposite sense to that shown in FIG. 1 and the mouthpiece 2' is shorter than mouthpiece 2. The operation of the device 1' shown in FIG. 5 should be evident in view of the discussion in relation to FIGS. 1 to 4 and the orientation of the display panel 4' in the extended state should be readily apparent. Once again the information presented on the display panel 4' will usually be on one face only, and this will usually be the face remote from the mouthpiece 2'. Nevertheless, information could be provided on both faces of the display device if desired and the device used to convey information to observers located in different relative positions to the user.

Advantageously, with the device 1, 1' as aforedescribed, when information is presented on the rear face $S_1$ thereof, the user, on facing an observer while blowing on the mouthpiece, is able to directly view the reaction of the observer from underneath the display panel (each eye being located on a respective side of the mouthpiece and angled tube).

Alternatively, or additionally, the device 1, 1' could be oriented upside down so that the display panel extends downwardly to display alternative or different information on said rear face $S_1$. In some instances, the device may be adapted for use in a different (e.g. sideways) orientation to display suitable information.

The mouthpiece could, in an alternative embodiment, be connected to a display portion comprising more than one rolled-up display panel and could be arranged, for example, with one rolled-up panel being extended vertically upwardly with simultaneous extension of a second rolled-up panel vertically downwardly.

Clearly, many possible combinations and configurations of the device 1, 1' are possible while retaining the spirit of the present invention.

It is to be understood that the scope of the present invention is not to be unduly limited by the particular choice of terminology and that a specific term may be replaced or supplemented by any equivalent or generic term where sensible. Further it is to be understood that individual features, method or functions related to the practical joke device or display panel and/or combinations thereof might be individually patentably inventive. In particular, any disclosure in this specification of a range for a variable or parameter (e.g. dimension D) shall be taken to include a disclosure of any selectable or derivable sub-range within that range and shall be taken to include a disclosure of any value for the variable or parameter lying within or at an end of the range.

The practical joke device could be thought of as an extensible display (which may perhaps be used for a purpose other than a practical joke) and the display panel as a message scroll and, therefore, for example, further according to the present invention there is provided an extensible display comprising a message scroll which is adapted to be unrolled to an extended position by means of air blown through a mouthpiece attached to the scroll, said scroll:

a) having an axial dimension in the rolled-up state which is at least 3 times greater than the width of the mouthpiece, and/or b) said scroll being displayable in an extended state along an axis which is displaced at an angle with respect to the axis of the mouthpiece.

Still further according to the present invention there is provided an extensible display or message scroll comprising an inflatable chamber in said scroll, resilient means providing a bias to restore said scroll to a stable rolled-up condition, and an inflation duct for admitting fluid under pressure into said chamber to extend said scroll against the bias, wherein said scroll comprises a panel arrangement which has a width of at least 15 to 100% of the extended length of the scroll and/or wherein said inflation duct incorporates a bend between a mouthpiece portion and the chamber.

We claim:

1. A hand-held practical joke and display device comprising:

a) a mouthpiece having a width and a longitudinal axis and being attached to a rolled-up display portion which can be unrolled and thereby extended upon delivering air through the mouthpiece from the mouth of a person using the device, said display portion being disposed at a angle with respect to the mouthpiece to display information carried on said display portion, b) said display portion including an air-inflatable chamber and a non-inflatable panel display element adapted for carrying and displaying information, c) said air-inflatable chamber being in flow communication with said mouthpiece and said non-inflatable panel display element being carried by said air-inflatable chamber whereby the display element unrolls when air is delivered to the mouthpiece and rolls up with the air-inflatable chamber when air is not delivered to the mouthpiece, d) the panel display element having a display area substantially greater than the area occupied by the air-inflatable chamber, e) said inflatable chamber being unrolled whenever air is blown into said mouthpiece to cause said non-inflatable panel element to be unrolled with said chamber to an extended dimension, f) in the unrolled condition, the extension direction of the panel display element and chamber is displaced at an angle with respect to the longitudinal axis of the mouthpiece, and g) resilient biassing means extend along the length of the air inflatable chamber for causing the unrolled display portion to roll up when air is not delivered through the mouthpiece from the mouth of the person using the device.

* * * * *